US007740231B2

(12) United States Patent
Winston, Jr.

(10) Patent No.: US 7,740,231 B2
(45) Date of Patent: Jun. 22, 2010

(54) EASY KNEE STAIR STRETCHER

(76) Inventor: Cleo Winston, Jr., 2720 N. Court St., Ottumwa, IA (US) 52501

( * ) Notice: Subject to any disclaimer, the term of this patent is extended or adjusted under 35 U.S.C. 154(b) by 36 days.

(21) Appl. No.: 12/283,388

(22) Filed: Sep. 11, 2008

(65) Prior Publication Data

US 2009/0079212 A1 Mar. 26, 2009

Related U.S. Application Data

(60) Provisional application No. 60/974,510, filed on Sep. 24, 2007.

(51) Int. Cl.
*B65H 77/00* (2006.01)

(52) U.S. Cl. ..... 254/209; 254/212; 294/8.6

(58) Field of Classification Search ..... 254/201–212; 294/806

See application file for complete search history.

(56) References Cited

U.S. PATENT DOCUMENTS 3,322,209 A * 5/1967 Cavanaugh ..... 173/132
4,003,549 A * 1/1977 Sergerie ..... 254/212
5,007,616 A * 4/1991 Scarpino ..... 254/212
5,484,136 A * 1/1996 Lopes et al. ..... 254/200
5,782,458 A * 7/1998 Prinzi et al. ..... 254/209
5,855,361 A * 1/1999 Krowchak ..... 254/209
6,491,284 B1 12/2002 Jolly et al.
6,698,721 B2 * 3/2004 Martin ..... 254/201
6,994,323 B2 * 2/2006 Carbajal ..... 254/212
7,114,704 B1 * 10/2006 Suckow ..... 254/209
2003/0107028 A1 * 6/2003 Martin ..... 254/200

OTHER PUBLICATIONS

Scorpion Stair Stretcher from the internet Unknown.
Roberts 10 258 Power Stretcher Tail from the internet Unknown.

* cited by examiner

*Primary Examiner*—Emmanuel M Marcelo
(74) *Attorney, Agent, or Firm*—James Ray & Assoc.

(57) ABSTRACT

An apparatus for installing carpeting, such apparatus comprises a substantially flat member having a plurality of teeth disposed on an underside thereof for biting into carpeting to be stretched. A handle member attached to such flat member on one end and to an elongated transmission means on another end. There is a connecting means that is engageable on one end to the handle and on the other end with the power transmission means for causing said power transmission means to force such apparatus to stretch such carpeting. The apparatus has an attachment means engageable with the transmission means on one end and with carpeting, wood or concrete on a second end for assisting in stretching such carpet when the apparatus is in use.

10 Claims, 3 Drawing Sheets

EASY KNEE STAIR STRETCHER

CROSS REFERENCE TO RELATED APPLICATIONS

This application is closely related to and claims benefit from U.S. Provisional Application Ser. No. 60/974,510 filed Sep. 24, 2007.

FIELD OF THE INVENTION

The present invention relates, in general, to installing carpeting, and, more particularly, the present invention relates to stretcher apparatus for assisting in installing carpeting on a flight of stairs.

BACKGROUND OF THE INVENTION

Those workers who install carpet know the stress this activity can cause on the body. Installing carpeting on stairs is especially hard on the knees particularly as most installers use the knees to assist in stretching the carpet in place. Many installers also find it difficult to apply carpeting beginning at the bottom of the stairs. Without the assistance of a helper, it is very difficult for a carpet installer to perform this task to the best of his ability. Stretching the carpeting so as to have a nice flat carpet without any bumps on a set of stairs is not an easy undertaking.

Thus, it would be advantageous if there were a simple and effective means of a tool that could assist the installer in stretching the carpeting from the bottom of the stairs and going up since this provides the installer to not only match patterns more easily but with the steps already done behind the installer it provides an easier and a better angle to stretch the carpet.

SUMMARY OF THE INVENTION

In a first aspect the present invention provides an apparatus for installing carpeting. The apparatus comprises a substantially flat member having a predetermined shape and formed of a predetermined material. A plurality of teeth are disposed on an underside of the substantially flat member, such plurality of teeth for biting into carpeting during stretching of such carpeting. A handle member is attached at one end thereof to a first predetermined portion of the substantially flat member. An elongated power transmission means is engageable on a first end with a second predetermined portion of the substantially flat member at substantially a midpoint thereon for causing the apparatus to stretch such carpeting. There is a connecting means that is engageable with the handle member on a first end thereof and with the elongated power transmission means on a second end thereof for causing the power transmission means to force the apparatus to stretch such carpeting when such handle member is cranked and an attachment means is engageable on a first end thereof with a second end of the elongated power transmission means and at a second end thereof with one of carpeting, cement and wood for assisting in stretching such carpeting when the apparatus is in use.

In a second aspect there is provides a method of installing carpeting on stairs by using a specially designed apparatus. The method comprises the steps of providing the specially designed apparatus which includes a substantially flat member having a plurality of teeth disposed on an underside thereof, a handle member attached to such substantially flat member, an elongated power transmission means is engageable on a first end with a predetermined portion of the substantially flat member, a connecting means is engageable with the handle member on one end thereof and with the power transmission means on a second end thereof and an attachment means is engageable on a first end thereof with such power transmission means and at a second end thereof with one of carpeting, cement and wood for assisting in stretching such carpeting when the apparatus is in use. There is a step of attaching the substantially flat member of the specially designed apparatus having a plurality of teeth disposed on an underside thereof to such carpet on a stair to be stretched. Another step is selecting an appropriate attachment member for a type of stair to be carpeted and a step of securing a second end of a bent tube member of the attachment member of the specially designed apparatus to one of a previous stair and carpeting disposed thereon. There is a step of cranking the handle member attached to the elongated power transmission means on the apparatus for causing such carpet to be stretched by such plurality of teeth forcing the carpeting in toward a riser of the stair and a step of removing the apparatus from the stair after such carpeting has been stretched on such stair and a step of repeating steps the previous steps on the next stair to be carpeted until all the stairs have been carpeted.

OBJECTS OF THE INVENTION

It is, therefore, one of the primary objects of the present invention to provide an apparatus for assisting in carpeting stairs.

Another object of the present invention is to provide an apparatus for assisting in carpeting stairs that has special attachments for use on wooden and for cement stairs.

Still another object of the present invention is to provide an apparatus for assisting in carpeting stairs that lessens the strain or stress on the body, especially on the knees when carpeting stairs.

In addition to the various objects and advantages of the invention which have been described in some specific detail above it should be noted that various other objects and advantages of the present invention will become more readily apparent to those persons who are skilled in the relevant art from the following more detailed description, particularly when such description is taken in conjunction with the appended claims.

Figure 1:
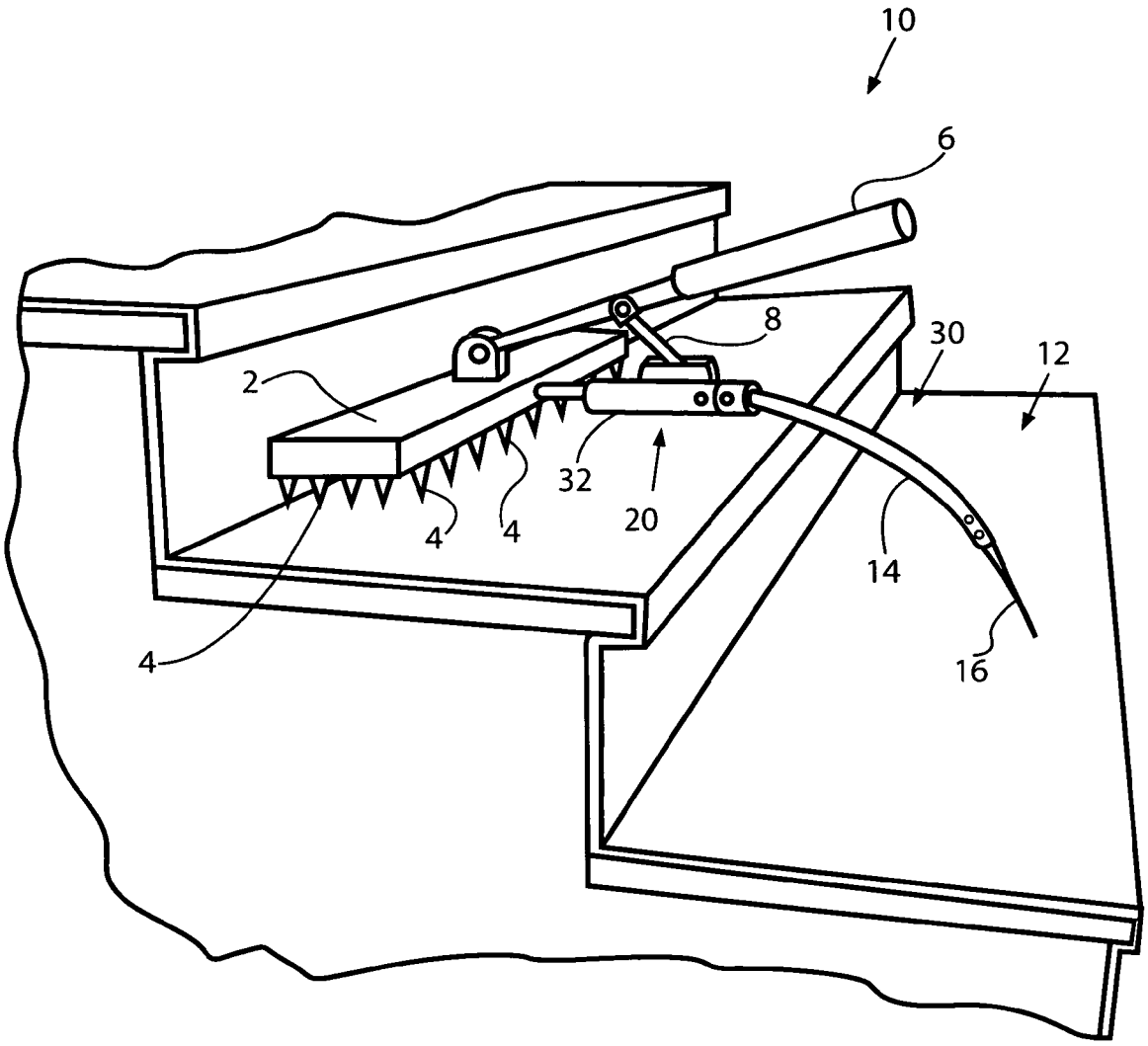
FIG. 1 is a side perspective view of the apparatus for assisting in carpeting stairs with a first attachment member for carpeting wooden stairs.
Figure 2:
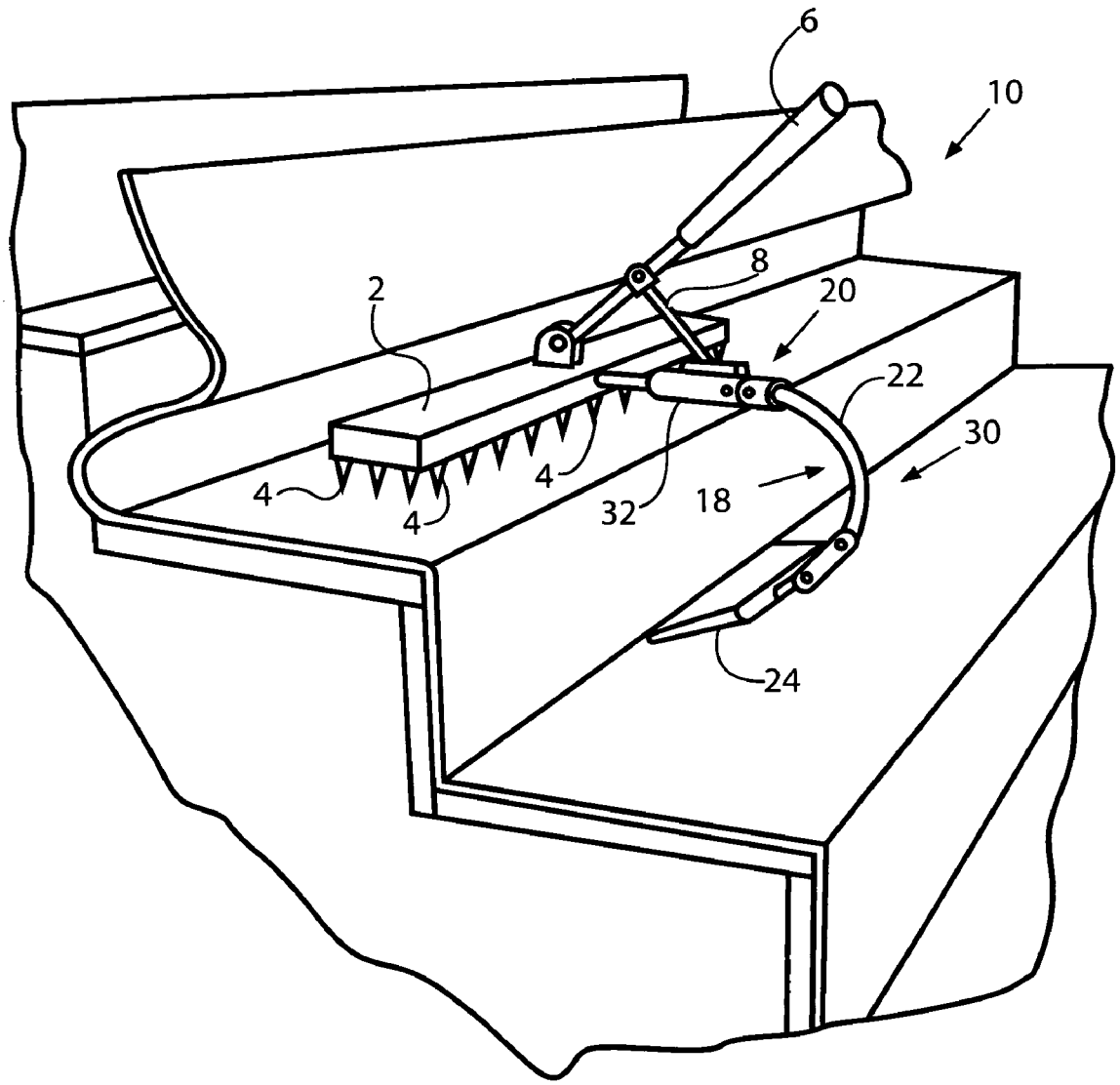
FIG. 2 is a side perspective view of the apparatus shown in FIG. 1 with a second attachment member attached for use on cement stairs.
Figure 4:
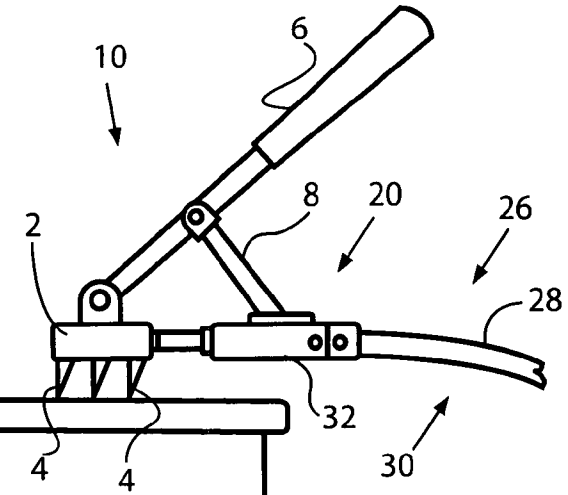
FIG. 4 is a side perspective view of the apparatus shown in FIG. 3 from a different angle.
Figure 3:
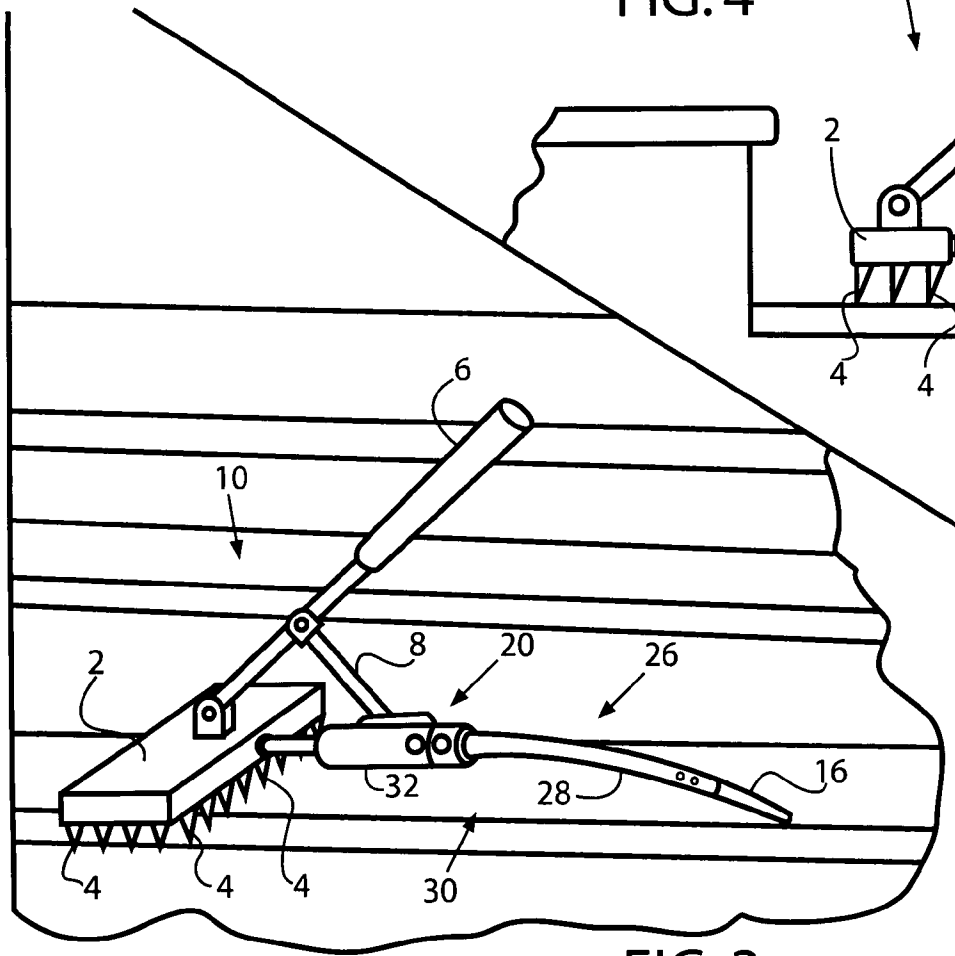
FIG. 3 is a side perspective view of the apparatus shown in FIG. 1 with a third attachment member attached for use in stretching the carpet in a side wise direction.

BRIEF DESCRIPTION OF THE PRESENTLY PREFERRED AND VARIOUS ALTERNATIVE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

In a first aspect the present invention provides an apparatus, generally designated 10, for installing carpeting. The apparatus 10 comprises a substantially flat member 2 having a predetermined shape and formed of a predetermined material. A plurality of teeth 4 are disposed on an underside of the substantially flat member 2, such plurality of teeth 4 for biting into carpeting during stretching of such carpeting. A handle member 6 is attached at one end thereof to a first predetermined portion of the substantially flat member 2. An elongated power transmission means 20 is engageable on a first end with a second predetermined portion of the substantially flat member 2 at substantially a midpoint thereon for causing the apparatus 10 to stretch such carpeting. There is a connecting means 8 that is engageable with the handle member 6 on a first end thereof and with the elongated power transmission means 20 on a second end thereof for causing the power transmission means 20 to force the apparatus 10 to stretch such carpeting when such handle member 6 is cranked and an attachment means 30 is engageable on a first end thereof with a second end of the elongated power transmission means 20 and at a second end thereof with one of carpeting, cement and wood for assisting in stretching such carpeting when the apparatus 10 is in use.

The attachment means 30 includes a first attachment member 12 for use on wooden stairs, such first attachment member 12 has a bent tube 14 with a pointed member 16 disposed on a second end thereof for engagement with one of such wooden stairs and carpeting disposed on such wooden stairs.

The bent tube 14 portion of the first attachment member 12 is bent between about 50 and about 70 degrees so that the pointed end 16 can securely engage a previous step that has been carpeted. Such pointed end 16 can engage either the carpeting or the wooded stair for a secure engagement thereto.

A second attachment member 18 is designed for use on cement stairs, such second attachment member 18 has a bent tube 22 with a spade member 24 disposed on a second end thereof for engagement with a vertex of a previously carpeted cement stair between a riser portion and a flat stair portion for securing the spade member 24 against such vertex.

The bent tube 22 of the second attachment member 18 is bent between about 130 and about 150 degrees. The bend is quite severe but is necessary so as to engage the previous stair at the vertex.

There is a third attachment member 26 for use on stairs or small hallways for stretching such carpet sideways, such third attachment member 26 has a bent tube 28 with a pointed member 16 disposed on second end thereof for engagement with at least one of a wooden floor, a wooden stair or carpeting disposed on one of such wooden stair and such wooden floor. Such bent tube 28 in the third attachment member 26 is bent between about 15 and about 30 degrees.

Such plurality of teeth 4 disposed on the underside of the flat member 2 are disposed in at least two rows. It is presently preferred that there are three rows of teeth 4 and that each row would have between about 8 and about 10 teeth 4.

Such elongated power transmission means 20 includes one of a piston 32, a ratchet, rack and pinion and gears. Only the piston 32 is shown in the drawing Figures but any of the other means for forcing the part of the apparatus 10 with the teeth 4 engaging the carpet would work equally well. However, it is presently preferred that such elongated power transmission means 20 is a piston member 32.

The piston member 32 is cranked by the handle member 6 so as to stretch such carpeting having the plurality of teeth from the apparatus engaged therein when such second end of the attachment means 30 is secured to one of a stair and carpeting.

In a second aspect there is provides a method of installing carpeting on stairs by using a specially designed apparatus 10. The method comprises the steps of providing the specially designed apparatus 10 which includes a substantially flat member 2 having a plurality of teeth 4 disposed on an underside thereof, a handle member 6 is attached to such substantially flat member 2, an elongated power transmission means 20 is engageable on a first end with a predetermined portion of the substantially flat member 2, a connecting means 8 is engageable with the handle member 6 on one end thereof and with the power transmission means 20 on a second end thereof and an attachment means 30 is engageable on a first end thereof with such power transmission means 20 and at a second end thereof with one of carpeting, cement and wood for assisting in stretching such carpeting when the apparatus is in use. There is a step of attaching the substantially flat member 2 of the specially designed apparatus 10 having a plurality of teeth 4 disposed on an underside thereof to such carpet on a stair to be stretched. Another step is selecting an appropriate attachment means 30 for the type of stair to be carpeted and a step of securing a second end of a bent tube member 14,22,28 of the attachment means 30 of the specially designed apparatus 10 to one of a previous stair and carpeting disposed thereon. There is a step of cranking the handle member 6 attached to the elongated power transmission means 20 on the apparatus 10 for causing such carpet to be stretched by such plurality of teeth 4 forcing the carpeting in toward a riser of the stair and a step of removing the apparatus 10 from the stair after such carpeting has been stretched on such stair and a step of repeating the previous steps on the next stair to be carpeted until all the stairs have been carpeted.

The method further includes a step of stretching the carpeting by using a first attachment member on such wooden stairs. The method also includes a step of stretching the carpeting by using a second attachment member on cement stairs. And the method also includes a step of stretching the carpeting sideways on the stair by using a third attachment member.

Thus, the present method is made specifically to assist carpet installers with applying carpeting to stairs. The apparatus provides a tool that is approximately 8 inches in length and about 2 inches wide having 3 rows of teeth underneath to bite into the carpet. Although the tool is describe essentially as a rectangle it could have a curved portion on one end without departing from the scope of the invention.

There is a handle member which is attached to the top portion of the tool but also to a piston type housing in which three different attachments can be attached. The first attachment is for wooden steps. It consists of an approximate 55 or 60 degree bent angle tubing and a point on the end for engagement with the wood or carpeting on a previous step. A second attachment is for use on concrete or cement stairs. It has a more pronounced curved attachment having a spade member on the end of it for engagement with the vertex of the previous step. The third attachment is for stretching carpet sideways on stairs or in a hallway and is a smaller version of the first attachment with only a slight bend in the tubular attachment. Thus when the end of the attachment is secured to the previous stair the handle is cranked and the piston forces the tool, with the teeth engaged to the carpeting to be stretched, in toward the riser thereby stretching the carpeting.

While a presently preferred embodiment and alternate embodiments of the present invention have been described in detail above, it should be understood that various other adaptations and/or modifications of the invention can be made by those persons who are particularly skilled in the art without departing from either the spirit of the invention or the scope of the appended claims.

I claim:

1. An apparatus for installing carpeting, said apparatus comprising:

(a) a substantially flat member having a predetermined shape and formed of a predetermined material;

(b) a plurality of teeth disposed on an underside of said substantially flat member, said plurality of teeth for biting into carpeting during stretching of such carpeting;

(c) a handle member attached at one end thereof to a first predetermined portion of said substantially flat member;

(d) an elongated power transmission means engageable on a first end with a second predetermined portion of said substantially flat member at substantially a midpoint thereon for causing said apparatus to stretch such carpeting;

(e) a connecting means engageable with said handle member on a first end thereof and with said elongated power transmission means on a second end thereof for causing said power transmission means to force said apparatus to stretch such carpeting when said handle member is cranked; and (f) an attachment means engageable on a first end thereof with a second end of said elongated power transmission means and at a second end thereof with one of carpeting, such carpeting disposed on one of concrete and wood for assisting in stretching such carpeting when said apparatus is in use, said attachment means having a bent tube with a spade member disposed on a second end thereof for engagement with a vertex of a previously carpeted stair between a riser portion and a flat stair portion for securing said spade member against such vertex.

2. The apparatus, according to claim 1, wherein said bent tube of said second attachment member is bent between about 130 and about 150 degrees.

3. The apparatus, according to claim 1, wherein said plurality of teeth are disposed in at least two rows.

4. The apparatus, according to claim 3, wherein each row of said at least two rows of teeth contain between about 8 and about 10 teeth.

5. The apparatus, according to claim 1, wherein said elongated power transmission means includes one of a piston, a ratchet, rack and pinion and gears.

6. The apparatus, according to claim 5, wherein said elongated power transmission means is a piston member.

7. The apparatus, according to claim 6, wherein said piston member is cranked by said handle member so as to stretch such carpeting having said plurality of teeth from said apparatus engaged therein when said second end of said attachment means is secured to one of a stair and carpeting.

8. A method of installing carpeting on stairs by using a specially designed apparatus, said method comprising the steps of:

(a) providing said specially designed apparatus including a substantially flat member having a plurality of teeth disposed on an underside thereof, a handle member attached to said substantially flat member, an elongated power transmission means engageable on a first end with a predetermined portion of said substantially flat member, a connecting means engageable with said handle member on one end thereof and with said power transmission means on a second end thereof and an attachment means engageable on a first end thereof with said power transmission means and at a second end thereof with one of carpeting, cement and wood for assisting in stretching such carpeting when said apparatus is in use;

(b) attaching said substantially flat member of said specially designed apparatus having a plurality of teeth disposed on an underside thereof to such carpet on a stair to be stretched;

(c) selecting an appropriate attachment member for a type of stair to be carpeted;

(d) securing a second end of a bent tube member of said attachment member of said specially designed apparatus to one of a previous stair and carpeting disposed thereon;

(e) stretching said carpeting using an attachment member having a bent tube with a spade member disposed on a second end thereof for engagement with a vertex of a previously carpeted stair between a riser portion and a flat stair portion for securing said spade member against such vertex.

(f) cranking said handle member attached to said elongated power transmission means on said apparatus for causing said carpet to be stretched by said plurality of teeth forcing said carpeting in toward a riser of said stair;

(g) removing said apparatus from said stair after such carpeting has been stretched on said stair; and (h) repeating steps (a) through step (g) with the next stair until all the stairs have been carpeted.

9. The method according to claim 8, wherein said method further includes a step of stretching said carpeting by using said attachment member on cement stairs.

10. The method according to claim 8, wherein said method further includes a step of stretching said carpeting sideways on said stair by using said attachment member.

* * * * *